US006817687B1

(12) United States Patent
Neeld et al.

(10) Patent No.: US 6,817,687 B1
(45) Date of Patent: Nov. 16, 2004

(54) FRAME TO FLOOR ANCHORING SYSTEM AND METHOD FOR USING THE SAME

(75) Inventors: Kenneth J. Neeld, West Chester, PA (US); Terry W. Louth, Narvon, PA (US)

(73) Assignee: Unisys Corporation, Blue Bell, PA (US)

( * ) Notice: Subject to any disclaimer, the term of this patent is extended or adjusted under 35 U.S.C. 154(b) by 33 days.

(21) Appl. No.: 10/295,162

(22) Filed: Nov. 15, 2002

(51) Int. Cl.[7] ..... A47B 91/00
(52) U.S. Cl. ..... 312/351.1; 312/351.7
(58) Field of Search ..... 312/351.1, 351.3, 312/351.7, 351.11, 351.13; 248/551, 500, 680, 223.41

(56) References Cited

U.S. PATENT DOCUMENTS 1,857,946 A * 5/1932 Dobson ..... 248/680
3,128,979 A * 4/1964 Damelio ..... 248/680
4,368,869 A * 1/1983 Gelvezon et al. ..... 248/656
4,770,475 A * 9/1988 Peterman ..... 312/201
4,789,121 A * 12/1988 Gidseg et al. ..... 248/188.2
5,046,790 A * 9/1991 Onomoto et al. ..... 312/351.13
5,131,617 A * 7/1992 McGarrah ..... 248/500
5,176,437 A * 1/1993 Remington ..... 312/351.1
5,215,367 A * 6/1993 Montuoro et al. ..... 312/401
5,470,042 A * 11/1995 Fietz et al. ..... 248/678
5,853,237 A * 12/1998 Powell et al. ..... 312/257.1
6,059,251 A * 5/2000 Gutelius et al. ..... 248/500
6,408,482 B1 * 6/2002 Henriott et al. ..... 16/29
6,533,238 B2 * 3/2003 Barnes et al. ..... 248/680

* cited by examiner

*Primary Examiner*—Peter M. Cuomo
*Assistant Examiner*—Sarah C. Burnham
(74) *Attorney, Agent, or Firm*—Lisa A. Rode; Mark T. Starr; RatnerPrestia

(57) ABSTRACT

A clamp for securing a cabinet frame having at least one support member is provided. The clamp includes a body portion configured to be fastened to a supporting surface. The clamp also includes at least one mounting portion coupled to the body portion. The mounting portion defines a recess positioned to at least partially surround a portion of the support member. The mounting portion includes a surface positioned to contact another portion of the support member when the body portion is fastened to the supporting surface, thereby securing the cabinet frame.

13 Claims, 10 Drawing Sheets

FRAME TO FLOOR ANCHORING SYSTEM AND METHOD FOR USING THE SAME

FIELD OF THE INVENTION

This invention relates to an anchoring system for securing a cabinet frame to a surface. More particularly, this invention relates to an anchoring system for securing a cabinet frame to a surface such as a computer room floor.

BACKGROUND OF THE INVENTION

This invention addresses problems associated with the securing a cabinet frame to a surface such as a computer room floor. Cabinet frames (e.g., computer cabinet frames) often include castors for moving the cabinet frame in the computer room. Further, cabinet frames often include leveling feet for leveling the cabinet frame in its installed position. In some locations, it is desirable to anchor the cabinet frame to the computer room floor to prevent motion of the cabinet. For example, this is particularly desirable in locations prone to earthquakes. In order to anchor the cabinet frame to the computer room floor, the castors and/or leveling feet are typically removed.

In order to remove the castors and/or leveling feet of the cabinet frame, the cabinet frame may be lifted to a height sufficient to allow removal of the castors and leveling feet prior to the final positioning and subsequent anchoring of the cabinet frame to the computer room floor. Alternatively, the cabinet frames are laid on their sides to remove the leveling feet and castors; however, the process of laying a fully loaded cabinet frame onto its side is cumbersome due to its weight and physical size.

Once the castors have been removed from the cabinet frame, it is difficult to precisely position the cabinet frame to a desired position on the computer room floor. Further, removal of the leveling feet takes away the ability to easily level the cabinet frame, and as such, other less effective and more difficult leveling methods (i.e., using shims) may be employed.

Further still, in some installations, where there are several cabinet frames positioned in a line, the leveling feet are useful for aligning the cabinet frames such that the front and/or top surfaces of the cabinet frames are not skewed with respect to each other.

As such, it would be desirable to provide a simple and effective apparatus for securing a cabinet frame to a computer room floor, without the need for removing the castors and/or leveling feet.

SUMMARY OF THE INVENTION

According to an exemplary embodiment of the present invention, a clamp for securing a cabinet frame having at least one support member is provided. The clamp includes a body portion configured to be fastened to a supporting surface. The clamp also includes at least one mounting portion coupled to the body portion. The mounting portion defines a recess positioned to at least partially surround a portion of the support member. The mounting portion also includes a surface positioned to contact another portion of the support member when the body portion is fastened to the supporting surface, thereby securing the cabinet frame.

According to another exemplary embodiment of the present invention, a cabinet frame assembly is provided. The cabinet frame assembly includes a cabinet frame having at least one support member. The cabinet frame assembly also includes a clamp including a body portion configured to be fastened to a supporting surface. The clamp also includes at least one mounting portion coupled to the body portion. The mounting portion defines a recess positioned to at least partially surround a portion of the support member. The mounting portion also includes a surface positioned to contact another portion of the support member when the body portion is fastened to the supporting surface, thereby securing the cabinet frame.

According to another exemplary embodiment of the present invention, a method of securing a cabinet frame including at least one support member is provided. The method includes at least partially surrounding a portion of the support member with a mounting portion of a clamp. The method also includes contacting a surface of the mounting portion of the clamp to another portion of the support member. The method also includes fastening a body portion of the clamp, coupled to the mounting portion, to a supporting surface, thereby securing the cabinet frame.

BRIEF DESCRIPTION OF THE DRAWINGS

Exemplary embodiments of the invention will be described with reference to the drawings, of which.

DETAILED DESCRIPTION OF THE INVENTION

Figure 1:
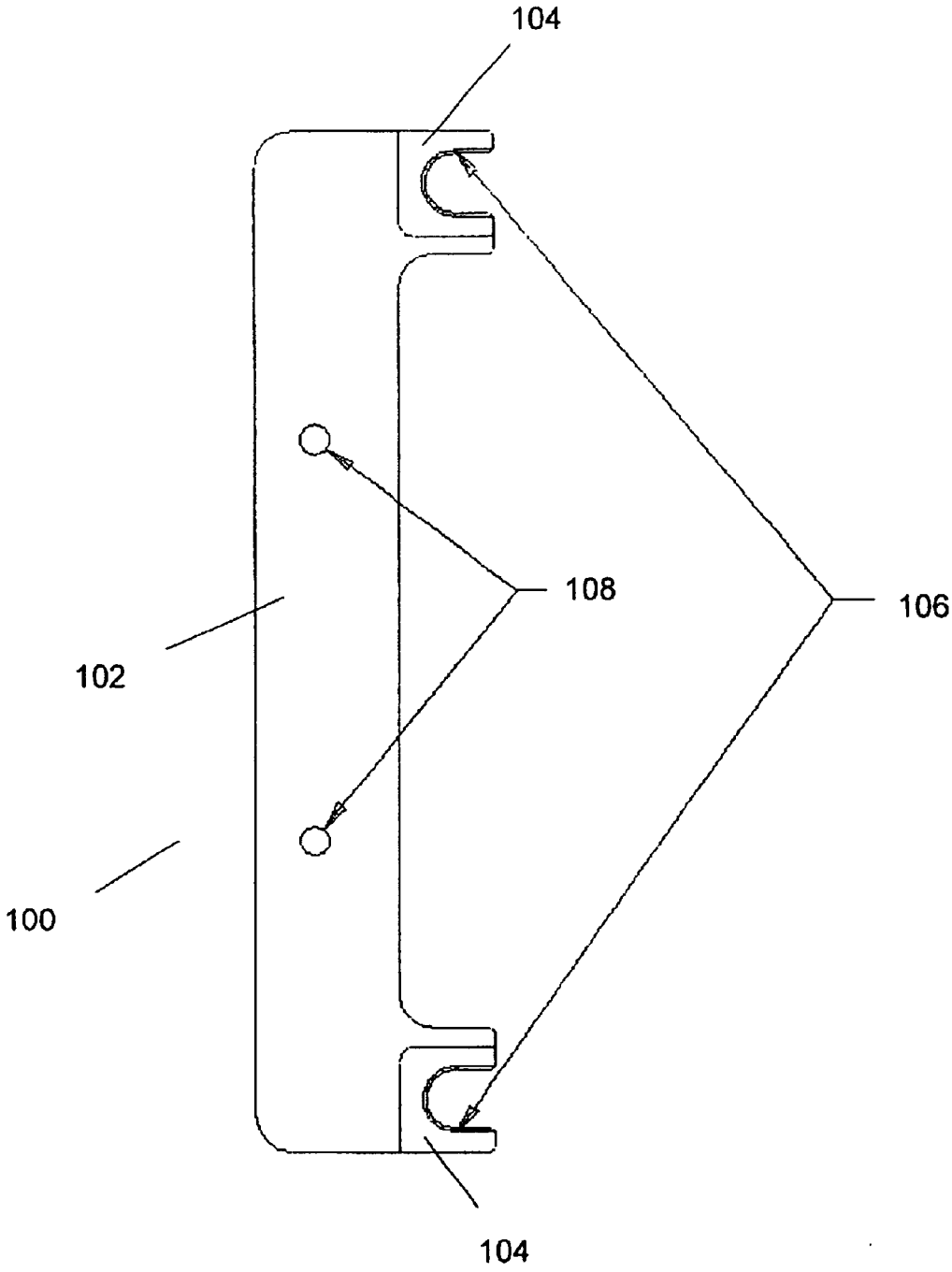
FIG. 1 is a bottom view of a clamp in accordance with an exemplary embodiment of the present invention.

Preferred features of selected embodiments of this invention will now be described with reference to the figures. It will be appreciated that the spirit and scope of the invention is not limited to the embodiments selected for illustration. Also. It should be noted that the drawings are not rendered to any particular scale or proportion. It is contemplated that any of the configurations and materials described hereafter can be modified within the scope of this invention.

Referring to the figures generally, a clamp 100 for securing a cabinet frame 301 having at least one support member 302 is provided. Clamp 100 includes a body portion 102 configured to be fastened to a supporting surface (e.g., a computer room floor). Clamp 100 also includes at least one mounting portion 104 coupled to body portion 102. Mounting portion 104 defines a recess 106 positioned to at least partially surround a portion 302*a* of support member 302. Mounting portion 104 also includes a surface positioned to contact another portion 302*b* of support member 302 when body portion 102 is fastened to the supporting surface, thereby securing cabinet frame 301.

A cabinet frame assembly 300 is also provided. Cabinet frame assembly 300 includes a cabinet frame 301 having at least one support member 302. Cabinet frame assembly 300 also includes a clamp 100 including a body portion 102 configured to be fastened to a supporting surface. Clamp 100 also includes at least one mounting portion 104 coupled to body portion 102. Mounting portion 104 defines a recess 106 positioned to at least partially surround a portion 302*a* of support member 302. Mounting portion 104 also includes a surface positioned to contact another portion 302*b* of support member 302 when body portion 102 is fastened to the supporting surface, thereby securing cabinet frame 301.

A method of securing a cabinet frame 301 including at least one support member 302 is also provided. The method includes at least partially surrounding a portion 302*a* of support member 302 with a mounting portion 104 of a clamp 100. The method also includes contacting a surface of mounting portion 104 of clamp 100 to another portion 302*b* of support member 302. The method also includes fastening a body portion 102 of clamp 100, coupled to mounting portion 104, to a supporting surface, thereby securing cabinet frame 301.

Exemplary features of selected embodiments of the invention will now be described with specific reference to FIGS. 1 through 6B.

Referring first to FIG. 1, a bottom view of a clamp 100 that may be used to secure a cabinet frame 301 to a supporting surface that supports cabinet frame 301 (e.g., a computer room floor) is illustrated. Clamp 100 includes a body portion 102 and two mounting portions 104. For example, body portion 102 may be integrally formed with mounting portions 104 (e.g., a molded clamp 100). Alternatively, clamp 100 may be formed by coupling together a distinct body portion 102 and mounting portions 104. Each of the mounting portions 104 defines a recess 106. Body portion 102 defines two apertures 108. Body portion 102 is configured to be fastened to a supporting surface that supports cabinet frame 301. Body portion 102 may be fastened to the supporting surface by extending fasteners 304 (not shown in FIG. 1) through apertures 108, and fastening the fasteners 304 to the supporting surface. Each recess 106 of a respective mounting portion 104 is positioned to at least partially surround a portion 302*a* of a support member 302 of cabinet frame 301 (not shown in FIG. 1) such that a surface of mounting portion 104 contacts another portion 302*b* of support member 302 when body portion 102 is fastened to the supporting surface.

Figure 2:
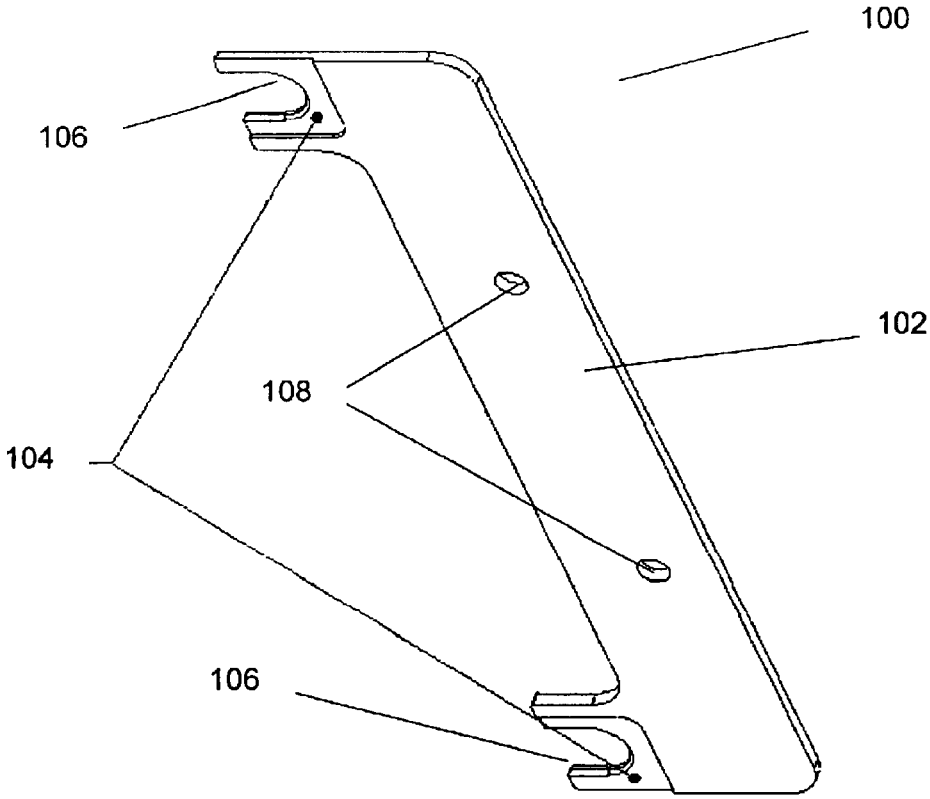
FIG. 2 is a perspective view of a clamp in accordance with an exemplary embodiment of the present invention.

FIG. 2 is a perspective view of a clamp 100 that may be used to secure cabinet frame 301 (not shown in FIG. 2) to a supporting surface that supports cabinet frame 301. As in FIG. 1, clamp 100 illustrated in FIG. 2 includes a body portion 102 and two mounting portions 104. Each mounting portion 104 defines a recess 106. Body portion 102 defines two apertures 108 that may be used in conjunction with fasteners 304 for fastening body portion 102 to the supporting surface.

Figure 3A:
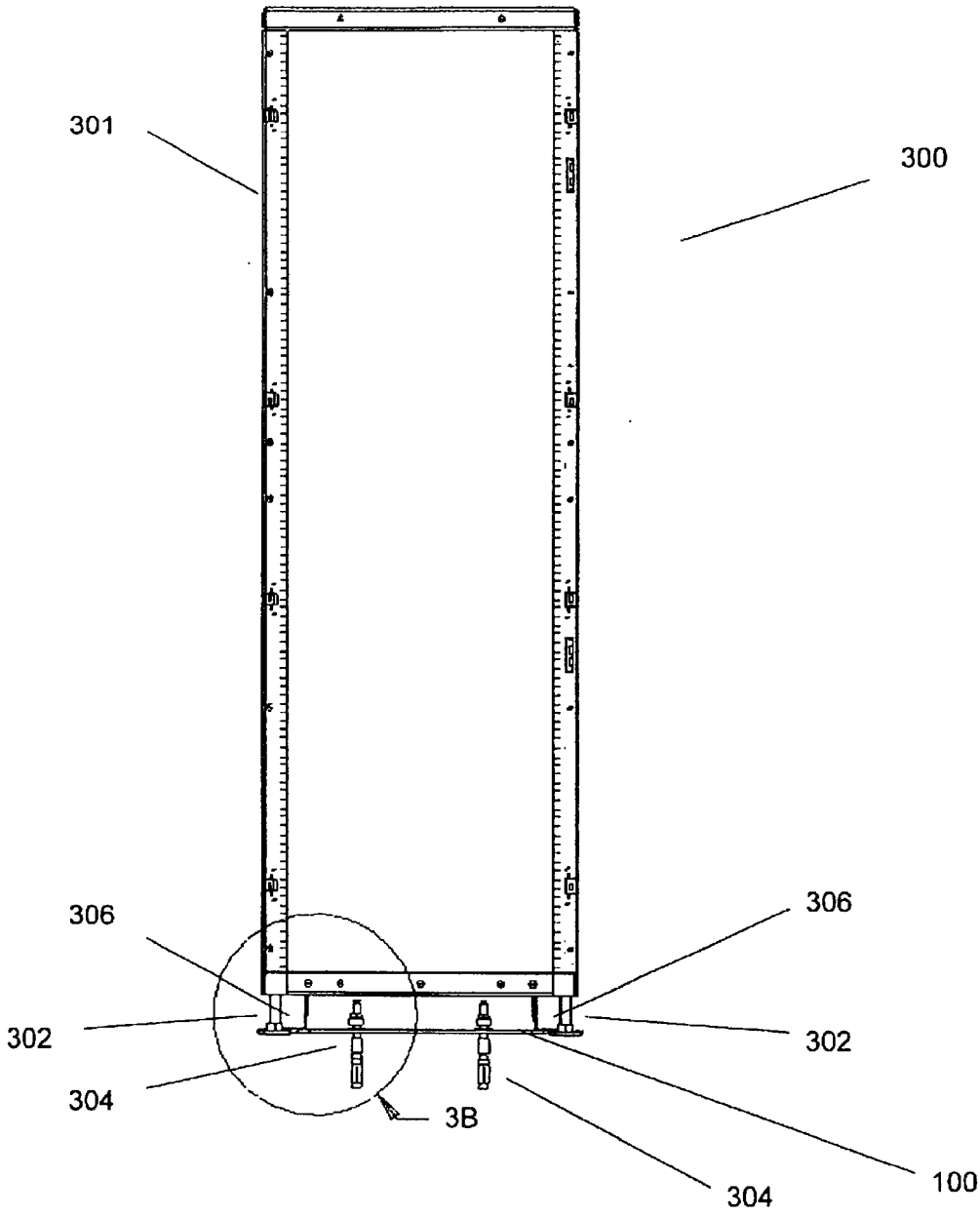
FIG. 3A is a front view of a cabinet frame assembly in accordance with an exemplary embodiment of the present invention.

FIG. 3A is a front view of a cabinet frame assembly 300. Cabinet frame assembly 300 includes cabinet frame 301. Cabinet frame 301 also includes support members 302. For example, cabinet frame 301 may include four support members 302, where each support member 302 supports a corner of cabinet frame 301. Support members 302 may be, for example, a leveling foot 302 of cabinet frame 301. Cabinet frame assembly 300 also includes clamp 100. In the exemplary embodiment shown in FIG. 3A, clamp 100 is used to secure cabinet frame 301 to a supporting surface (e.g., a computer room floor) by securing two support members 302 to the supporting surface; however, clamp 100 may be used in conjunction with any other number of support members 302. For example, one clamp 100 could be provided to couple each respective support member 302 to the supporting surface, and as such, four clamps 100 may be used. Referring again to FIG. 3A, clamp 100 is secured to the supporting surface by engaging fasteners 304 with each of the apertures 108 defined by the body portion of clamp 100. Fasteners 304 extend through apertures 108 and into the supporting surface (not shown in FIG. 3A). Detail 3B, shown in FIG. 3A, is shown in greater detail in FIG. 3B.

Figure 3B:
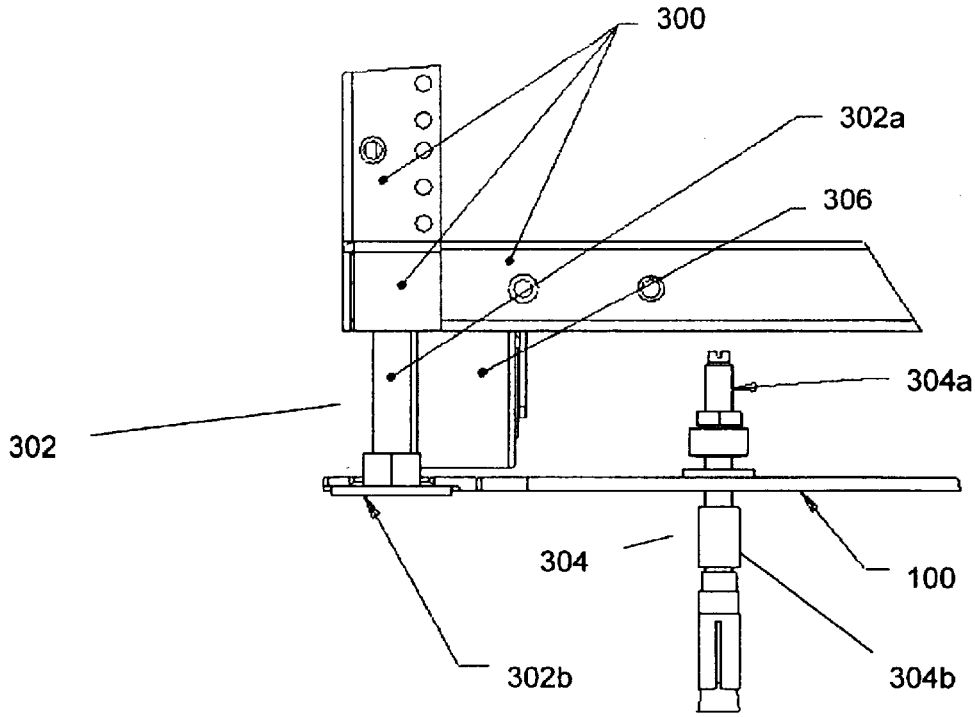
FIG. 3B is a detailed front view of a portion of a cabinet frame assembly in accordance with an exemplary embodiment of the present invention.

FIG. 3B provides a detailed view of a portion of cabinet frame assembly 300 shown in FIG. 3A. In the exemplary embodiment of the present invention shown in FIG. 3B, cabinet frame assembly 300 includes wheels 306. For example, cabinet frame 301 may include four wheels 306, one wheel 306 at each of the four corners of the cabinet frame assembly 300. Wheels 306 may be used to move cabinet frame 301 before securing cabinet frame 301 to the supporting surface by rolling wheels 306 along the supporting surface. FIG. 3B provides a detailed view of support member 302. For example, support number 302 may be a leveling foot 302. Leveling foot 302 includes a shaft portion 302*a* (e.g., a threaded shaft portion), and a leveling foot pad 302*b*. As such, each recess 106 of a respective mounting portion 104 of clamp 100 is positioned to at least partially surround a respective shaft portion 302*a* of leveling foot 302. Further, another surface of mounting portion 104 is configured to contact leveling foot pad 302*b* when clamp 100 is fastened to the supporting surface.

FIG. 3B also provides a detailed view of exemplary fastener 304. For example, fastener 304 may be an anchor bolt assembly 304. Anchor bolt assembly 304 may include an upper portion 304*a* that is used to engage a lower portion 304*b*, thereby coupling clamp 100 to the supporting surface that supports cabinet frame assembly 300.

Figure 4A:
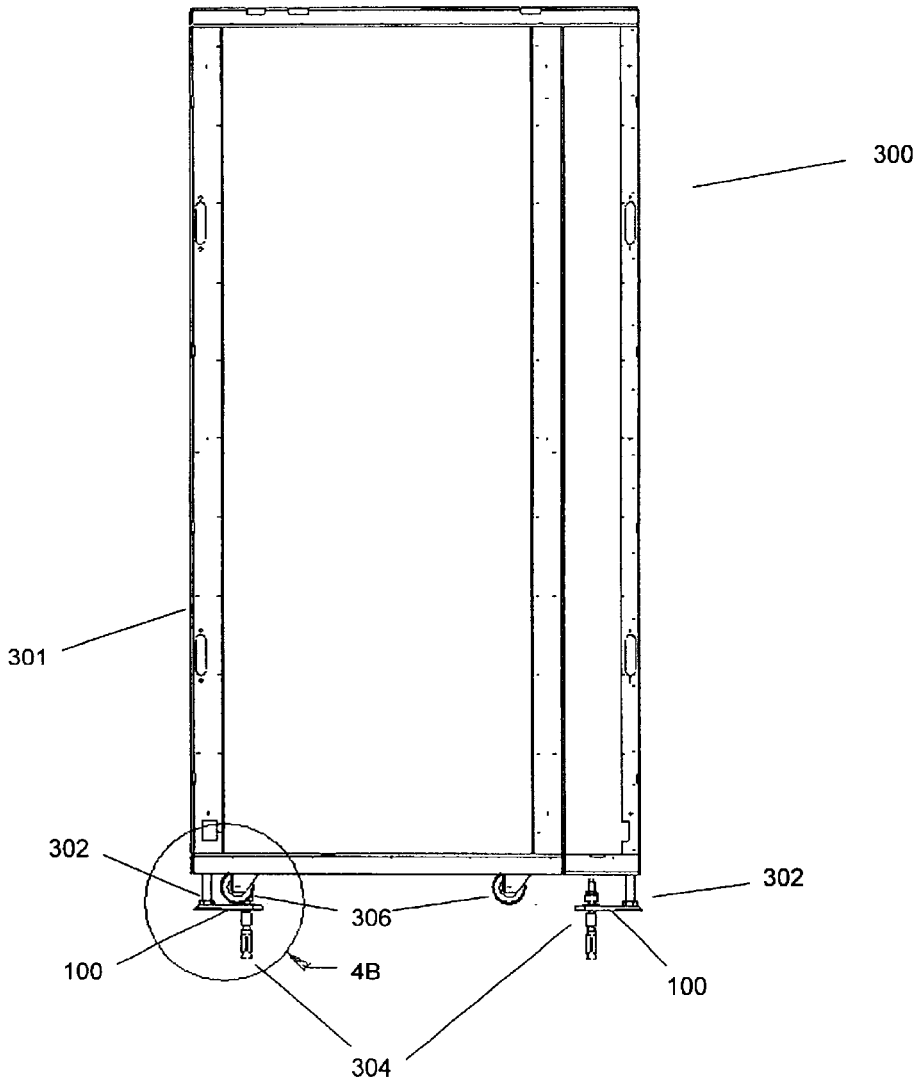
FIG. 4A is a side view of a cabinet frame assembly in accordance with an exemplary embodiment of the present invention.

FIG. 4A is a side view of cabinet frame assembly 300, including cabinet frame 301. The exemplary embodiment of the present invention shown in FIG. 4A is a cabinet frame assembly 300 that includes two clamps 100. For example, each of the two clamps 100 may be used to couple two support members 302 of cabinet frame 301 to a supporting surface. FIG. 4A also illustrates fasteners 304 for fastening clamp 100 to the supporting surface. FIG. 4A also provides a side view of wheels 306. Support members 302 are also shown in FIG. 4A. Detail 4B, shown in FIG. 4A, is shown in greater detail in FIG. 48.

Figure 4B:
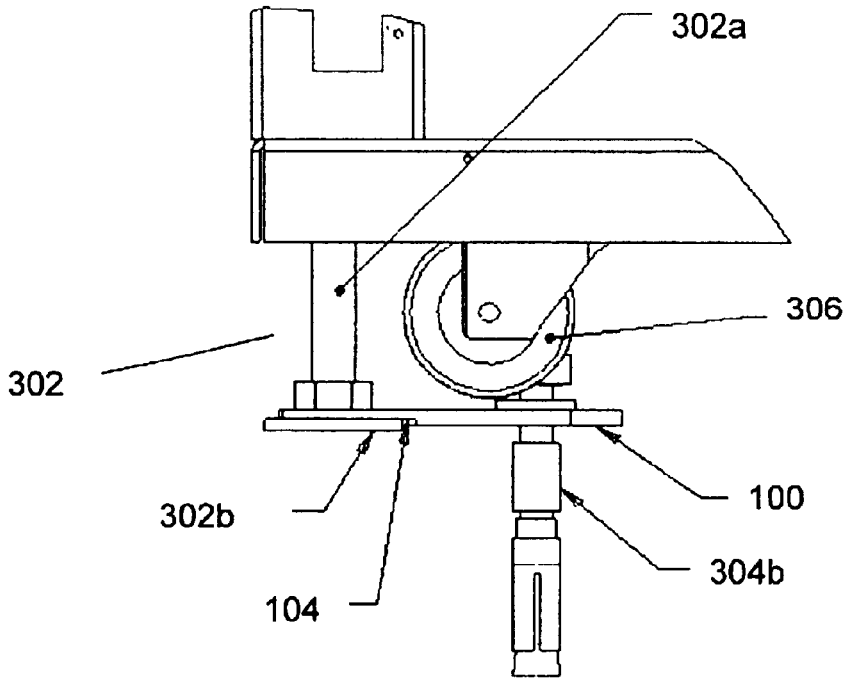
FIG. 4B is a detailed side view of a portion of a cabinet frame assembly in accordance with an exemplary embodiment of the present invention.

FIG. 4B is a detailed side view of a portion of cabinet frame assembly 300 shown in FIG. 4A. As in FIG. 3B, support member 302 (e.g., leveling foot 302) includes support member shaft 302*a* (e.g., threaded leveling foot shaft 302*a*) and leveling foot pad 302*b*. Wheel 306 is shown in a raised position above a top surface of clamp 100. As such, when leveling foot pad 302*b* is in contact with the supporting surface (e.g., the computer room floor) wheel 306 is not in contact with the supporting surface. This is because leveling feet 302 have been used to raise cabinet frame 301 with respect to the supporting surface such that wheels 306 are no longer in contact with the supporting surface. Fastener 304, used for engagement with an aperture 108 defined by body portion 102, is also shown in FIG. 4B.

As made clear in FIG. 4B, mounting portion 104 of clamp 100 includes a lower surface (facing the supporting surface) that is raised above a lower surface of clamp 100 (that contacts the supporting surface). As such, when the lower surface of clamp 100 is in contact with a planar surface (e.g., a floor) the lower surface of mounting portion 104 would not be in contact with the planar surface. This allows mounting portion 104 to contact a top portion of leveling foot pad 302B, while clamp 100 remains in contact with the supporting surface.

Figure 5A:
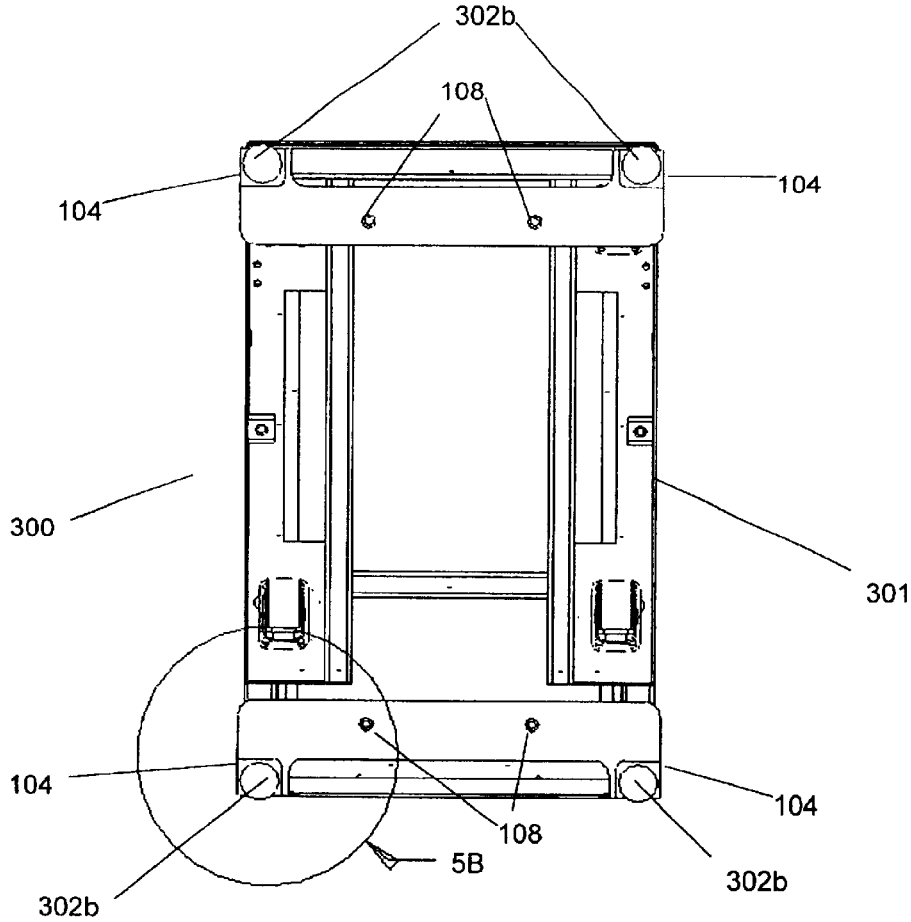
FIG. 5A is a bottom view of a cabinet frame assembly in accordance with an exemplary embodiment of the present invention.

FIG. 5A is a bottom view of cabinet frame assembly 300. In the exemplary embodiment shown in FIG. 5A, cabinet frame assembly 300 includes cabinet frame 301, and four support members 302 (e.g., leveling feet 302). In FIG. 5A, only the bottoms of leveling feet 302 (e.g., leveling foot pad 302*b*) are visible. Cabinet frame assembly 300 also includes two clamps 100. Each clamp 100 includes two mounting portions 104, each of the mounting portions 104 configured for engagement with a respective support member 302. Each clamp 100 also includes two apertures 108. Fasteners 304 (e.g., screws, bolts, nails, etc.) may be extended through apertures 108 and fastened to the supporting surface, thereby securing cabinet frame 301. Detail 5B, shown in FIG. 5A, is shown in greater detail in FIG. 5B.

Figure 5B:
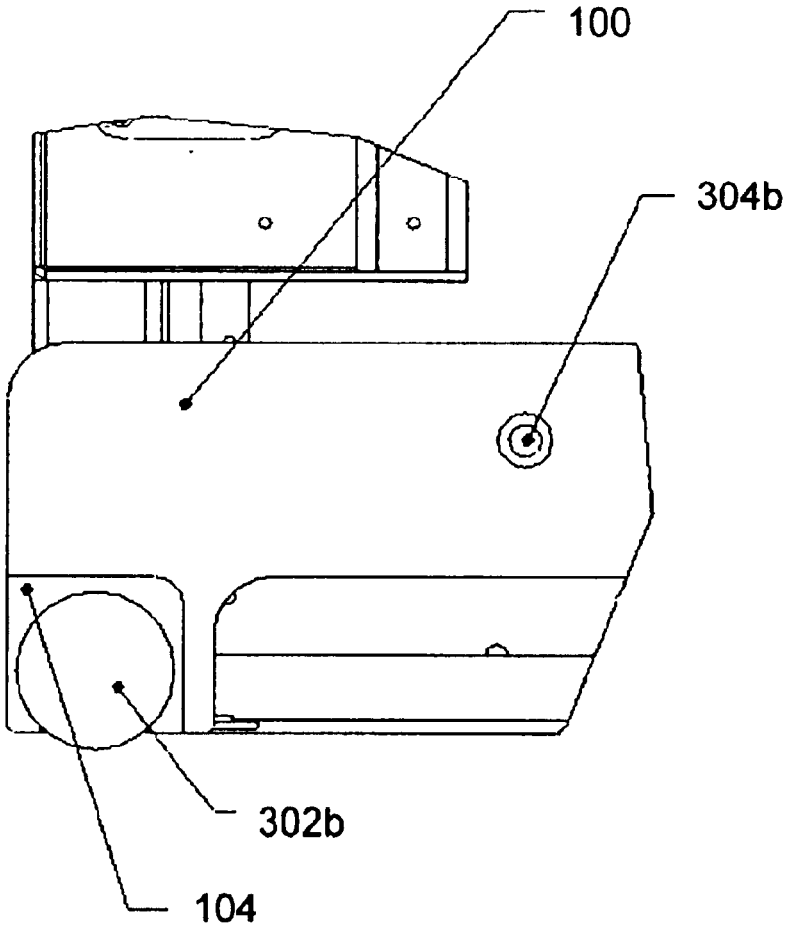
FIG. 5B is a detailed bottom view of a portion of a cabinet frame assembly in accordance with an exemplary embodiment of the present invention.

FIG. 5B is a detailed bottom view of a portion of cabinet frame assembly 300 shown in FIG. 5A. Clamp 100 includes mounting portion 104 configured for engagement with support member 302 (including leveling foot pad 302*b*). Mounting portion 104 includes a recess 106 (see FIGS. 1–2). Recess 106 partially surrounds a portion of support member 302 (e.g., shaft portion 302*a*) when mounting portion 104 engages support member 302. A surface of mounting portion 104 is positioned to contact another portion of support member 302 (e.g., leveling foot pad 302*b*) when clamp 100 is fastened to the supporting surface (see FIG. 4B).

Figure 6A:
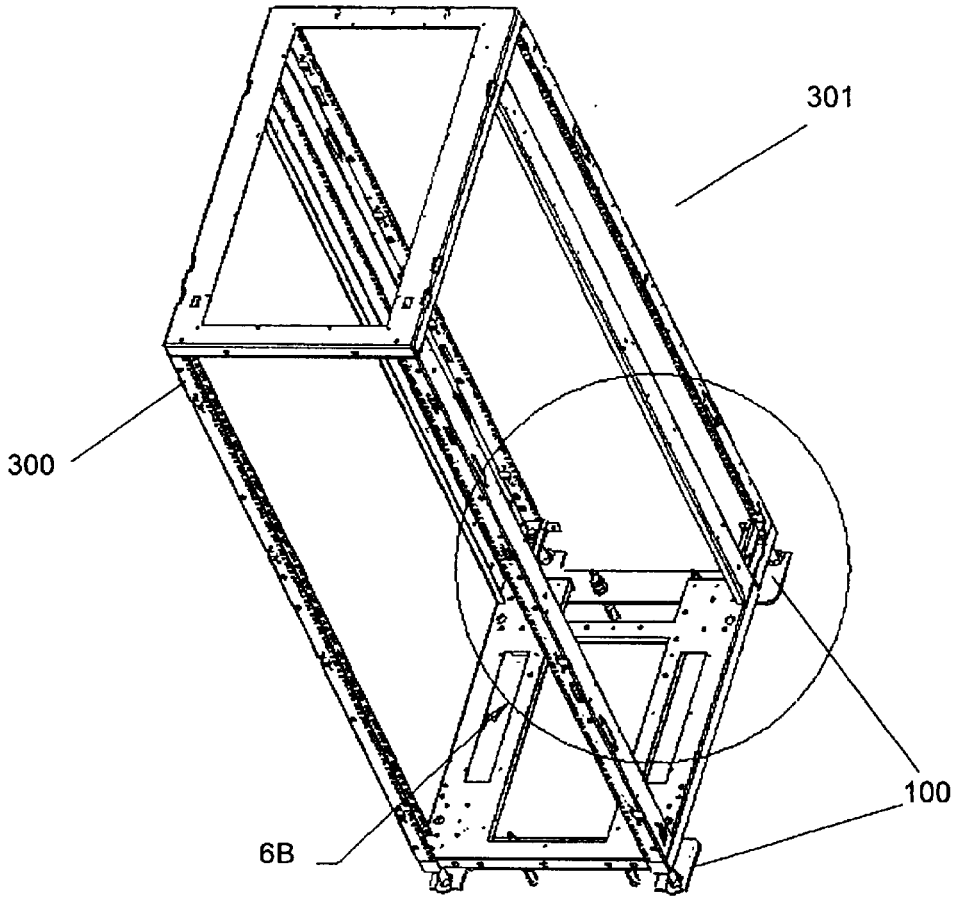
FIG. 6A is a perspective view a cabinet frame assembly in accordance with an exemplary embodiment of the present invention.

FIG. 6A is a perspective view of a cabinet frame assembly 300 including cabinet frame 301. In the exemplary embodiment of the present invention illustrated in FIG. 6A, two clamps 100 are used to secured cabinet frame 301 to a supporting surface that supports cabinet frame 301. Detail 6B shown in FIG. 6A, is shown in greater detail in FIG. 6B.

Figure 6B:
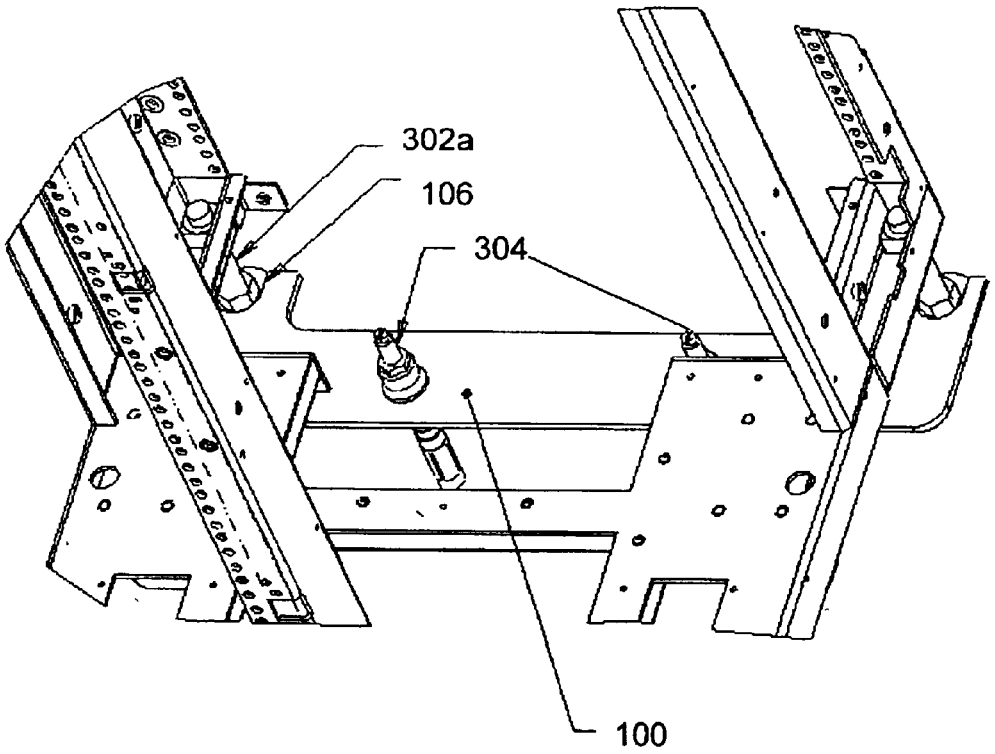
FIG. 6B is a detailed perspective view of a portion a cabinet frame assembly in accordance with an exemplary embodiment of the present invention.

FIG. 6B is a detailed perspective view of a portion of cabinet frame assembly 300 shown in FIG. 6A. FIG. 6B provides a detailed illustration of the engagement of recess 306 and shaft portion 302*a* of support member 302. Fasteners 304 are also shown extending through apertures 108 (not shown) and fastened to the supporting surface (not shown).

In an exemplary embodiment of the present invention, the procedure for securing cabinet frame 301 to the supporting surface (e.g., a computer room floor) is as follows: Cabinet frame 301 may be moved to a desired position using wheels 306 that are attached to the bottom of cabinet frame 301. Leveling feet 302 are then lowered such that a bottom surface of each leveling foot pad is in contact with the computer room floor, and wheels 306 are no longer in contact with the computer room floor. Cabinet frame 302 is then leveled using leveling feet 302, for example, where a leveling foot 302 is included to support and level each of four corners of cabinet frame 301. Clamp 100 (or multiple clamps) is then positioned such that each of the recesses 106 defined by the mounting portions 104 at least partially surround (i.e., straddles) the shaft portion 302*a* of respective leveling foot 302. For example, clamp 100 may include two mounting portions 104, and as such, includes two recesses 106 for at least partially surrounding two respective shaft portions 302*a* (as shown in FIGS. 3A, 4A and 5A). As such, one clamp 100 may be used to secure the front two support members 302, and another clamp 100 may be used to secure the rear two support members 302 (when cabinet frame 301 includes four support members, two in the front, two in the rear).

Of course, other arrangements may also be used, for example clamp 100 may include one mounting portion 104 defining one recess 106 for engagement with one support member 302. In such an embodiment, if cabinet frame 301 includes four support members 302 (one for supporting and leveling each corner of cabinet frame 301), then four clamps 100 may be used, each clamp 100 for securing one support member 302 to the supporting surface.

After positioning the clamps 100, holes may be drilled into the computer room floor to line up with the apertures 108 (e.g., anchor bolt holes) defined by body portion 102 of clamp 100. Of course, these holes may be drilled prior to the positioning of cabinet frame 301, prior to the positioning of clamp 100, or clamp 100 may be used as a template to position the floor holes. If two clamps 100 are used, then the holes must be drilled to line up with apertures 108 in each clamp 100. Fasteners 104 (e.g., anchor bolts) are then extended through apertures 108 (anchor bolt holes) defined by each clamp 100 and are then secured to the computer room floor.

Cabinet frames 301 typically house rack mounted units that are slid in and out on rails included in cabinet frame 301 in order to perform service on the rack mounted units. Sliding the rack mounted units in and out of cabinet frame 301 may result in tipping of cabinet frame 301. If a stabilizing mechanism (e.g., a stabilizer pad or leg) was coupled to cabinet frame 301 to avoid tipping, the stabilizing mechanism may produce a tripping hazard, and additionally, the stabilizing mechanism occupies space. In an exemplary embodiment of the present invention, clamps 100 are installed within the footprint of cabinet frame 301 (as shown in FIGS. 3A, 4A and 5A) such that there are no legs, brackets, etc. protruding beyond cabinet frame 301 that could pose a hazard to personnel walking adjacent to cabinet frame 301.

In an exemplary embodiment of the present invention clamps 100 are fastened to a secure portion of the supporting surface (e.g., a concrete sub floor, building steel, etc) as opposed to a removable raised floor panel in a computer room.

In an exemplary embodiment of the present invention, clamps 100 may be captive to the leveling foot 302 such that the threaded shaft portion 302*a* of the leveling foot 302 fits through a hole in clamp 100, as opposed to the threaded shaft portion 302*a* sitting within a recess or fork in mounting portion 104 of clamp 100.

In yet another exemplary embodiment of the present invention, recesses, forks, or apertures (e.g., anchor bolt holes) may be directly formed into the leveling foot pads 302*b*, such that a fastener may be used to secure the leveling foot 302 to the supporting surface.

Although certain embodiments of the present invention have been illustrated using two clamps 100, each for securing two leveling feet 302, other configurations are contemplated. For example, four clamps 100 could be provided, each to secure one of four leveling feet 302. Further, it may not be necessary to secure each of the leveling feet 302. For example, in an embodiment where cabinet frame 301 includes four leveling feet 302, only one clamp 100 may be used to secure two leveling feet 302. Further still, although various exemplary embodiments herein described use one clamp 100 to secure the front two leveling feet 302, and a second clamp 100 to secure the rear two leveling feet 302, one clamp 100 could be used to secure one front leveling foot 302 and one rear leveling foot 302. As such, any number of clamps 100 may be included to secure any number of leveling feet 302 so long as the cabinet frame 301 is secured to the supporting surface.

Although certain embodiments of the present invention have been illustrated using clamps 100 with two apertures 108 for receiving two fasteners 304, any number of apertures 108 may be defined by body portion 102 for receiving any number of fasteners 304. For example, each clamp 100 may define only one aperture 108 for receiving one fastener 304.

Although anchor bolt assembles 304 have been shown as an exemplary fastener 304 that may be used to fasten clamp 100 to the supporting surface, and type of fastener 304 may be used that adequately secures clamp 100 to the supporting surface. For example, various types of fasteners (e.g., bolts, screws, nails, anchors, etc.) may extend through apertures 108 and be connected to the supporting surface. Further, clamp 100 may be fastened to the supporting surface without use of fasteners. For example, clamp 100 may be coupled to the supporting surface using an adhesive, or any other apparatus or method that adequately secures clamp 100 to the supporting surface.

It will be appreciated that other modifications can be made to the illustrated embodiments without departing from the scope of this invention, which is separately defined in the appended claims.

What is claimed:

1. A clamp for securing a cabinet frame having at least one leveling support member, said clamp comprising:

a body portion configured to be fastened to a supporting surface; and at least one mounting portion coupled to said body portion, said mounting portion defining an open-ended recess positioned to partially surround a portion of the leveling support member and a surface positioned to contact another portion of the leveling support member when said body portion is fastened to the supporting surface, thereby securing the cabinet frame, said surface of said mounting portion being raised with respect to the supporting surface when said body portion is fastened to the supporting surface, said clamp being configured to be positioned beneath the cabinet frame when the at least one leveling support member is on the supporting surface such that when said body portion is fastened to the supporting surface, said clamp does not extend beyond a footprint of the cabinet frame.

2. The clamp of claim 1 wherein said body portion defines at least one aperture for receiving a fastener for fastening said body portion to the supporting surface.

3. The clamp of claim 2 wherein said aperture is configured to receive a bolt for fastening said body portion to the supporting surface.

4. The clamp of claim 1, said clamp including at least two of said mounting portions wherein each of said recesses is positioned to partially surround a respective leveling support member when said body portion is fastened to the supporting surface.

5. A cabinet frame assembly comprising:

a cabinet frame having at least one leveling support member; and a clamp including a body portion configured to be fastened to a supporting surface and at least one mounting portion coupled to said body portion, said mounting portion defining an open-ended recess positioned to partially surround a portion of said leveling support member and a surface positioned to contact another portion of said leveling support member when said body portion is fastened to the supporting surface, thereby securing said cabinet frame, said surface of said mounting portion being raised with respect to the supporting surface when said body portion is fastened to the supporting surface, said clamp being configured to be positioned beneath the cabinet frame when the at least one leveling support member is on the supporting surface such that when said body portion is fastened to the supporting surface, said clamp does not extend beyond a footprint of the cabinet frame.

6. The cabinet frame assembly of claim 5 wherein said body portion defines at least one aperture for receiving a fastener for fastening said body portion to the supporting surface.

7. The cabinet frame assembly of claim 6 wherein said aperture is configured to receive a bolt for fastening said body portion to the supporting surface.

8. The cabinet frame assembly of claim 5 wherein said leveling support member comprises a leveling mechanism.

9. The cabinet frame assembly of claim 8 wherein said leveling mechanism includes a shaft portion and a pad portion coupled to said shaft portion, said pad portion being vertically moveable by operation of said shaft portion such that said cabinet frame is lifted above the supporting surface when said pad portion is lowered to be in contact with the supporting surface.

10. The cabinet frame assembly of claim 9 wherein said shaft portion is threaded, said pad portion being lowered to be in contact with the supporting surface by rotation of said threaded shaft portion.

11. The cabinet frame assembly of claim 9, said cabinet frame assembly including a plurality of said leveling mechanisms for supporting said cabinet frame above the supporting surface, wherein each of said shaft portions is positioned to be partially surrounded by one of said recesses, and each of said pad portions being configured to be contacted by a respective one of said surface of said mounting portion when said body portion is fastened to the supporting surface.

12. The cabinet frame assembly of claim 5, said cabinet frame assembly additionally comprising a plurality of wheels for moving said cabinet frame with respect to the supporting surface, said wheels being vertically moveable such that said wheels may be raised above the supporting surface when said body portion is fastened to the supporting surface.

13. The cabinet frame assembly of claim 5, said cabinet frame assembly including four of said leveling support members and two of said clamps, each of said clamps including two of said mounting portions such that each of said clamps engages two of said four leveling support members.

* * * * *